United States Patent [19]

Miller, IV et al.

[11] 4,372,018

[45] Feb. 8, 1983

[54] COMBINED CASKET AND BURIAL VAULT ASSEMBLY WITH STACKABLE COMPONENTS

[76] Inventors: John P. K. Miller, IV, 42 Magnolia Ave.; Benjamin T. Breazeale, II, 39 Maple Ave., both of Okaloosa County, Shalimar, Fla. 32579

[21] Appl. No.: 306,654

[22] Filed: Sep. 29, 1981

[51] Int. Cl.[3] ..... A61G 17/00

[52] U.S. Cl. ..... 27/35; 27/27

[58] Field of Search ..... 27/35, 2, 7, 27

[56] References Cited

U.S. PATENT DOCUMENTS

| | | | |
|---|---|---|---|
| 2,759,239 | 8/1956 | Snyder | 27/27 |
| 2,802,253 | 8/1957 | Birck | 27/27 |
| 3,172,183 | 3/1965 | Bugg | 27/35 X |
| 4,139,929 | 2/1979 | Angermann | 27/35 |
| 4,249,289 | 2/1981 | Work | 27/35 |
| 4,265,006 | 5/1981 | Angermann | 27/35 |
| 4,320,562 | 3/1982 | Kelley | 27/2 |

*Primary Examiner*—John D. Yasko

[57] ABSTRACT

A combined casket and burial vault assembly comprises a casket lid having a peripheral depending lip, a casket body having tapered side walls, tapered end walls, and a peripheral flange portion adapted for receiving the casket lid thereon, a removable half couch, and a reusable display carrier having two opposed side walls, two opposed end walls and a reinforced bottom wall. The depending lip of the casket lid and the peripheral flange portion of the casket body are tapered in a complementary manner to create a hermetic seal when the lid is placed on the casket body. The display carrier includes ornamental hardware and hand rails or other carrying means for transporting the combined assembly from place to place. The casket lids, casket bodies and half couches are all separately stackable in a nested manner to facilitate storage. The casket lids and casket bodies are provided with removable interior lining and padding for attachment when needed. A further feature of the invention resides in the use of separate interment bars to enable vertical removal of the casket body from the reusable display carrier.

10 Claims, 16 Drawing Figures

COMBINED CASKET AND BURIAL VAULT ASSEMBLY WITH STACKABLE COMPONENTS

BACKGROUND OF THE INVENTION

1. Field of the Invention

The present invention relates generally to caskets and burial vaults for the interment of human or animal remains, and is particularly concerned with a combined casket and burial vault assembly which provides an improved sealing arrangement between the casket lid and casket body and individual stackability of the non-reusable components of the assembly.

2. Description of the Prior Art

Burial caskets of the type which are in common use at the present time are generally heavy, bulky structures made of wood or metal and fitted with a great deal of elaborate ornamentation. The use of burial caskets of this type is rather uneconomical, not only because of the materials usually used in the construction of the casket body itself, but also because of the expensive ornamentation which, not being removable, must be buried with the casket. From the standpoint of the funeral home, moreover, burial caskets of this type are difficult to store because of their large size and their inability to be conveniently disassembled. For this reason, a great deal of space is ordinarily required in order to maintain an adequate supply of caskets in stock. A further complication arises from the fact that, due to the inability of some types of burial caskets to be sealed completedly or to withstand the soil loads of interment, the casket must be placed in a massive burial vault made of concrete or some other suitable material.

In an effort to reduce the high costs associated with conventional types of burial caskets, designs have been proposed for caskets made of fiberglass and other lightweight materials. See, for example, U.S. Pat. No. 3,545,055 and Canadian Pat. No. 787,062. The problem with these designs, however, is that they lack provision for the stylized ornamentation normally associated with traditional caskets and therefore, present a rather plain appearance which may not be pleasing to the purchaser.

In still another attempt to reduce the expense of conventional burial caskets, it has been proposed that the functions of the casket and burial vault may be combined in one unit. U.S. Pat. No. 3,172,183, for example, discloses a combined casket and burial vault of fiberglass construction which consists of three pieces, namely, a top shell half, a bottom shell half, and a cradle support member. The top and bottom shell halves are joined in a peripheral tongue and groove sealing arrangement which requires a sealant to cement the two pieces together. A disadvantage of this design, however, is that it requires a separate cradle member for additional support against the heavy soil loads of interment. Moreover, the shell design does not provide for the usual ornamental handles or other decorative hardware that is normally desired by purchasers of burial caskets.

A more recent proposal along these lines can be found in U.S. Pat. No. 4,139,929. This patent discloses a display and burial containment system consisting of a combined casket and burial vault and a reusable three-sided display unit, all of molded fiberglass construction. Ornamental hardware is attached to the reusable display unit, thereby eliminating the need to inter the ornamentation along with the casket. However, because of the three-sided construction of the display unit, it is not well suited for use by pallbearers in carrying the casket from place to place. Moreover, the design requires four separate component parts in order to prepare the casket and burial vault for interment, namely, the casket or display container per se, a structural outer base, and first and second cover units, and also requires a sealant to cement the four pieces together.

To date, casket designs which use fiberglass or other lightweight materials, or which combine the functions of display casket and burial vault, have met with only limited acceptance in spite of their reduced expense. What is required is a combined casket and burial vault assembly which not only can be constructed of fiberglass or other lightweight and inexpensive materials, but which also provides for the desired degree of ornamental hardware. Moreover, the assembly should require only a minimum number of separate components, and should not rely exclusively on a sealant or adhesive material in order to prepare the assembly for interment.

SUMMARY OF THE INVENTION

In accordance with the present invention, a combined casket and burial vault assembly of molded material includes a casket body having two opposed side walls, two opposed end walls and a bottom wall. The side walls and end walls taper outwardly from the bottom wall at an angle relative to the vertical and terminate at their upper edges in a peripheral flange portion which defines an enlarged top opening for the casket body. The flange portion comprises a flared portion extending outwardly from the side walls and end walls at an angle relative to the vertical which is greater than the taper angle of the side walls and end walls, respectively, and an upstanding lip portion which tapers outwardly from the flared portion at an angle less than the angle of the flared portion relative to the vertical. The upstanding lip portion terminates in a free edge surface which is suited for receiving, optionally, a sealant material. In addition, the upstanding lip portion has a peripheral ledge surface on one side thereof which extends along the interior of the casket body and defines a narrow support surface below the top opening of the casket body.

The combined casket and burial vault assembly also includes a removable half couch which has a convex top portion and a flat bottom edge for resting on the flat peripheral ledge defined below the opening of the casket body, and a lid which is received on the casket body in sealing engagement therewith. The lid has a convex top portion and a depending lip portion at the periphery thereof. The lip portion tapers inwardly from the convex top portion of the lid in a manner which complements the outward taper of the upstanding lip portion at the opening of the casket body. In the preferred embodiment, the free edge of the depending lip portion of the lid is enclosed by a generally U-shaped gasket which provides a decorative molding for the edges of the casket lid. The gasket includes an outwardly flared tongue portion extending along one side thereof.

When the lid is placed on the casket body, the depending lip portion overhangs and grippingly engages the correspondingly tapered upstanding lip portion of the casket body, whereby a hermetic seal is created between the two. In addition, the free edge surface of the upstanding lip portion of the casket body is brought into contact with the interior surface of the convex top portion of the lid, whereby a sealant material may be retained therebetween to further enhance the seal. When the edges of the lid are provided with the U-shaped gasket or molding, as in the preferred embodiment, the flared tongue portion of the molding is brought into firmly abutting contact with the tapered upstanding lip portion of the casket body to create the desired heremetic seal.

The combined casket and burial vault assembly also includes a display carrier comprising two opposed side walls, two opposed end walls, and a bottom wall. The side walls and end walls of the carrier terminate in a free edge surface which, when the casket body is placed in the carrier, is brought into abutting contact with the peripheral flange portion of the casket body at the point where the flared portion joins the tapered side walls and end walls of the casket body. The bottom wall of the carrier is constructed in a reinforced manner in order to provide additional support for the casket body. To this end, the bottom wall preferably comprises several lateral support beams and a flat base portion which forms a bottom enclosure for the display carrier. The flat base portion extends slightly less than the internal length and width of the bottom opening of the carrier in order to provide a circumferential opening for allowing air to move freely into and out of the carrier during insertion and removal of the casket body. A plurality of handrails or other carrying means are affixed to side walls of the casket carrier for allowing the combined assembly to be transported from place to place. The casket body may be vertically removed from the casket carrier by means of a pair of interment bars, each comprising a straight carrying bar, two depending L-shaped bars with their horizontal legs extending inwardly, and a pair of inclined support plates which are attached to the horizontal legs of the L-shaped bars at an angle that corresponds to the outwardly flared portion of the casket body.

The combined casket and burial vault of the present invention provides a number of important advantages over the prior art. In the first place, the aforementioned sealing arrangement between the casket body and the lid allows the assembly to be hermetically sealed without the use of a sealant material, although a sealant material can be provided if desired. The tapered depending lip portion of the casket lid extends over the correspondingly tapered upstanding lip portion of the casket body in a gripping manner to assure a tight seal. If the edges of the lid are provided with a U-shaped gasket or molding, as in the preferred embodiment, the flared tongue portion of the molding also assists in the creation of the seal.

A further advantage of the present invention resides in the provision of the half couch having a flat bottom edge surface along two or more of its edges for resting on the peripheral ledge surface defined below the opening in the casket body. This manner of construction allows the half couch to be readily removed from the assembly, if desired, thereby decreasing the number of non-reusable components.

The design of the reusable display carrier allows ornamental hardware and handrails or other carrying means to be placed thereon. This facilitates the display and carrying of the assembly from one place to another without having to inter the expensive ornamentation. A further advantage of the present invention resides in the manner in which the casket is supported within the carrier. In particular, the bottom wall of the casket body rests on the reinforcing lateral support beams of the display carrier while, in addition, the free upper edge surface of the casket carrier abuts the outwardly extending flange portion of the casket body at the point where the flared portion joins the tapered side walls and end walls of the casket body. This provides the casket body with two means of support while resting in the carrier, thereby positively insuring that the casket does not drop through the carrier bottom.

BRIEF DESCRIPTION OF THE DRAWINGS

These and other objects, advantages and novel features of the present invention will be more readily apprehended from the following detailed description when read in conjunction with the appended drawings, in which.

DETAILED DESCRIPTION OF THE PREFERRED EMBODIMENT

Figure 1:
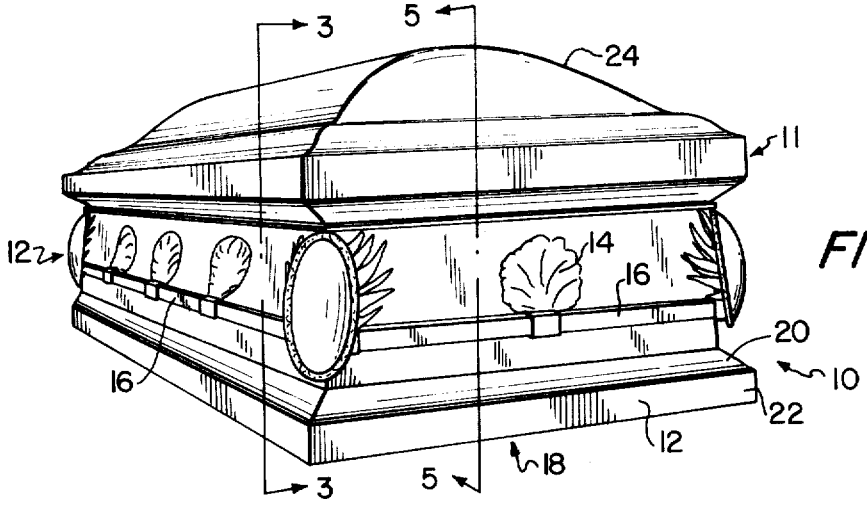
FIG. 1 is a perspective view of an assembled casket and burial vault in accordance with the present invention.

With reference to the drawings, FIG. 1 is a perspective view of a combined casket and burial vault assembly 10 constructed in accordance with the present invention. The assembly 10 generally comprises a non-reusable casket portion 11 and a reusable display carrier unit 12 in which the casket 11 is received as shown. The combined casket and burial vault assembly 10 is constructed of a molded resinous glass fiber material, usually referred to as fiberglass, which has a thickness of about one-eighth of one inch. The casket carrier 12 is provided with ornamental hardward 14 and handrails 16 for use by pallbearers in moving the casket from place to place.

Figure 2:
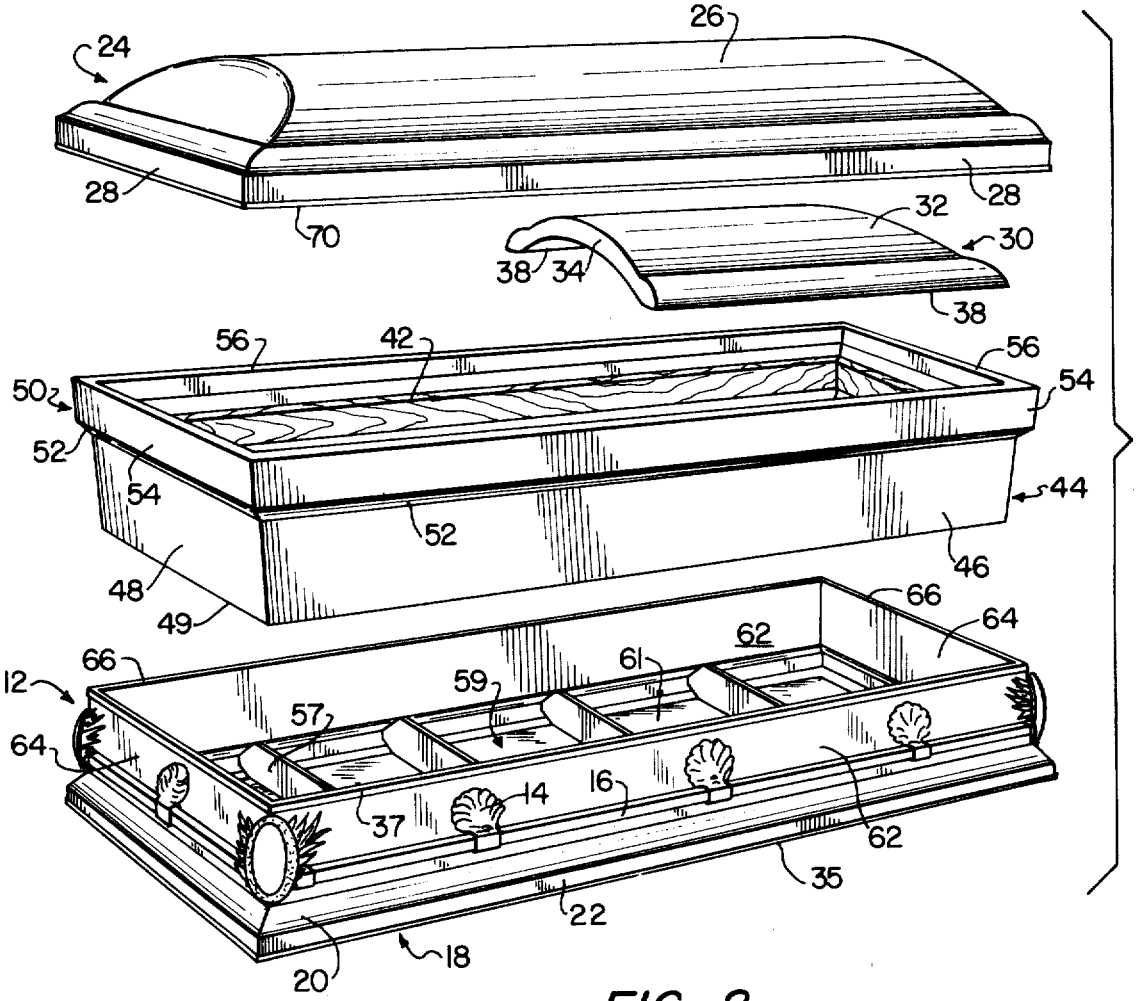
FIG. 2 is an exploded perspective view of the component parts of the combined casket and burial vault assembly.
Figure 3:
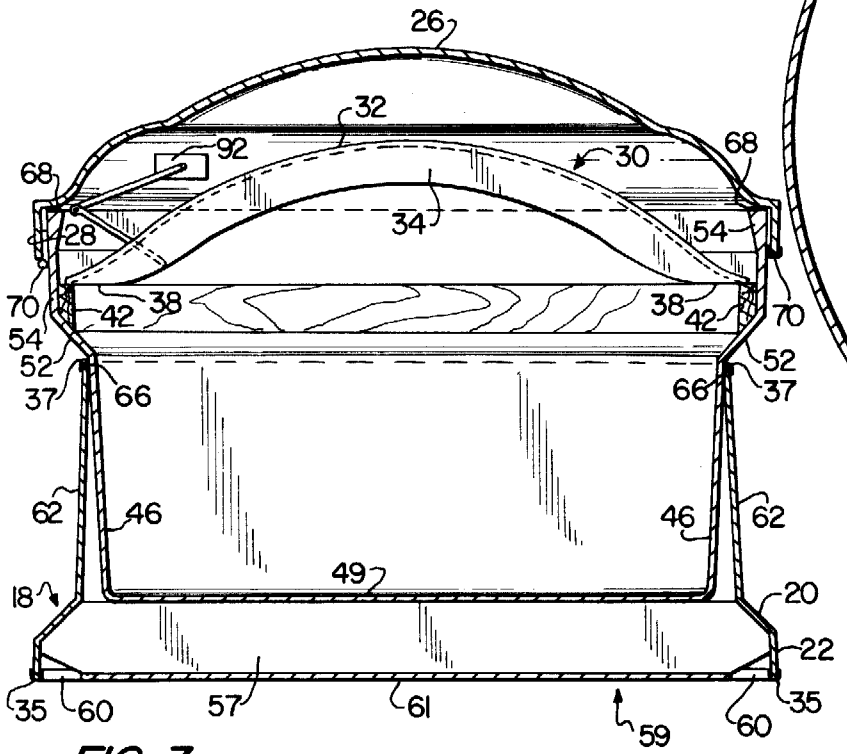
FIG. 3 is a cross sectional view taken along line 3—3 of FIG. 1, illustrating the relationship of the component parts of the combined casket and burial vault assembly and the manner in which the casket lid extends over the casket body in the closed position.

The component parts of the combined casket and burial vault assembly 10 are more clearly illustrated in FIG. 2, which is an exploded perspective view of the assembly, and in FIG. 3, which is a cross sectional view taken along line 3—3 of FIG. 1. The casket lid 24 has a convex top portion 26 and a depending peripheral lip portion 28, the latter tapering inwardly from the top portion 26 at an angle of about one-half inch to the foot and being terminated with a U-shaped gasket or molding 70 running along the periphery thereof. The depending lip portion 28 of the casket lid 24 extends over the upstanding tapered lip portion 54 of the side walls 46 and end walls 48 of the casket body 44. The casket body 44 has side walls 46 and end walls 48 which taper outwardly from the bottom wall 49 at an angle of about one-half inch to the foot with respect to the vertical. The upper portion of the side walls 46 and end walls 48 terminate in a peripheral flange portion 50. The peripheral flange portion 50 comprises an outwardly flared portion 52 extending from the side walls 46 and end walls 48 at an angle of about 45° with respect to the vertical, and an upstanding lip portion 54 which extends outwardly from the flared portion 52 at taper angle less than that of the flared portion 52, preferably about one-half inch to the foot relative to the vertical. The upstanding lip portion 54 terminates in a flat free edge surface 56 which is suitable for receiving a sealant material 68, although it should be understood that the sealant material 68 is optional. The casket body also has a peripheral ledge surface 42 which extends along the interior of the casket body 44 at a point along the upstanding lip portion 54 of the peripheral flange 50. The peripheral ledge 42, which consists of a wooden material molded into the fiberglass casket body 44, defines a narrow support surface for receiving the half couch 30 below the top opening 58 of the casket body 44.

With continued reference to FIGS. 2 and 3, the display carrier 12 has a reinforced bottom wall 59 which may comprise, for example, several lateral support beams 57 and a plywood base 61 which forms a bottom enclosure for the display carrier. The lateral support beams 57 are molded into the interior walls of the carrier 12 at the point where the bottom roll 18 joins with the carrier sidewalls 62 and end walls 64. The plywood base 61 is attached to the support beams 57, thereby providing a flat surface for the casket carrier 12 to rest on the top of a carrying tray (not shown). The carrier 12 further has two opposed side walls 62 and two opposed end walls 64 which preferably extend inwardly from the bottom wall 59 at a taper angle of about one-half inch to the foot relative to the vertical, and terminate in a free edge surface 66. It should be understood that the inward taper of the side walls and end walls of the carrier 12 is not critical, and these walls may be made vertical if desired. The casket carrier 12 has a bottom roll or overhanging skirt 18 which comprises a flared portion 20 formed at an angle of about 45° with respect to the vertical, and a wall portion 22 that is substantially vertical. The bottom roll 18 rests on the top of a casket carrying tray (not shown), which is normally used for moving the casket from one place to another. The bottom roll 18 is substantially closed on the bottom, as shown, by the plywood base 61, although the base 61 extends somewhat less than the length and width of the bottom to provide a circumferential opening 60 along the edge of the plywood base 61 and the internal surface of the bottom roll 18. The opening 60 facilitates the removal of the casket body 44 from the display carrier 12 by allowing air to move freely into the interior of the carrier 12, thereby alleviating the vacuum effect which can be caused by lifting the casket body 44 out of the casket carrier 12. Insertion of the casket body 44 into the carrier 12 is facilitated by the opening 60 in a similar manner. With reference now to FIG. 3, and also to FIG. 5 which is a cross sectional view taken along the line 5—5 of FIG. 1, the casket body 44 is supported within the casket carrier 12 in part by the free edge surface 66 of the carrier, which abuts the outwardly extending flange portion 50 of the casket body 44 at the point where the flared portion 52 joins the tapered side walls 46 and the tapered end walls 48 of the casket body 44. The casket body 44 is also supported by the lateral support members 57 of the carrier 12. This double support method spreads the weight of the casket portion 11 to the side walls 62 and end walls 64 of the display carrier 12 as well as to the bottom wall 59, and thus assures that the casket body 44 will not drop through the display carrier.

Figure 5:
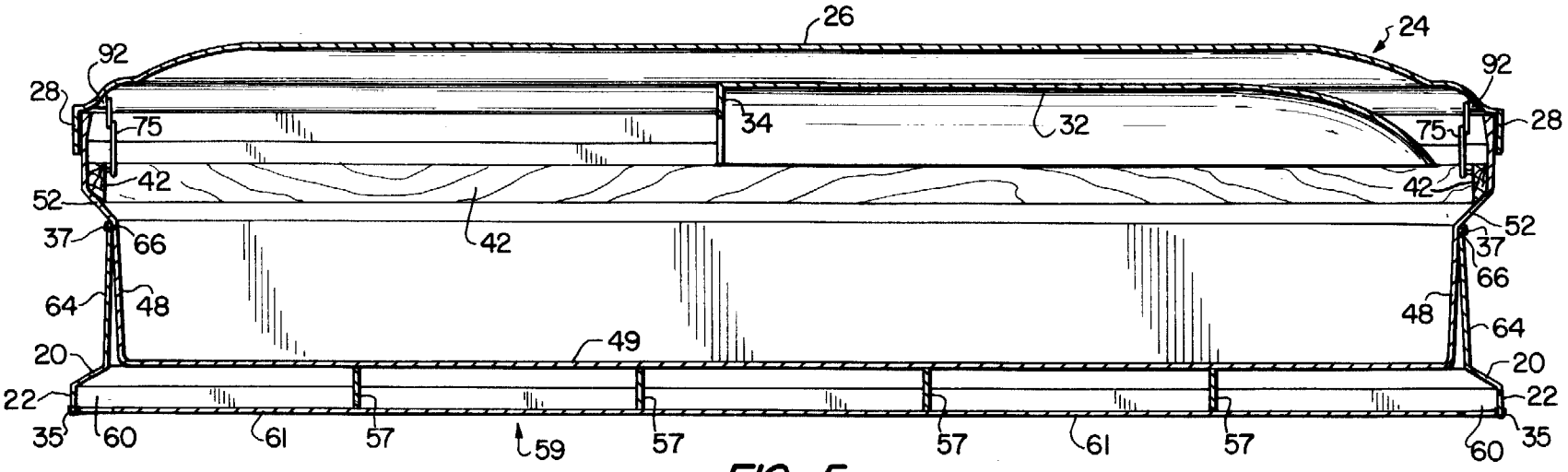
FIG. 5 is a cross sectional view taken along line 5—5 of FIG. 1, illustrating the relationship of the half couch to the casket body and lid.

With continued reference to FIGS. 3 and 5, the half couch 30 includes a convex top portion 32 and a downturned lip portion 34 at one end of the half couch 30 to conceal the lower portion of the remains during display. The half couch also has a flat bottom surface portion 38 which extends along the side edges thereof, as shown, for resting on the peripheral ledge surface 42 which extends along the interior of the casket body 44. As best seen in FIGS. 2 and 5, the half couch 30 extends from substantially the midpoint of the casket body 44 and tapers downward to the end wall 48 of the casket body 44. The half couch 30 is removable from the combined casket and burial vault assembly 10 at the time of interment and also during storage. This serves to facilitate the stacking or nesting of one casket body 44 within another and to decrease funeral costs since less component parts are interred.

Figure 4:
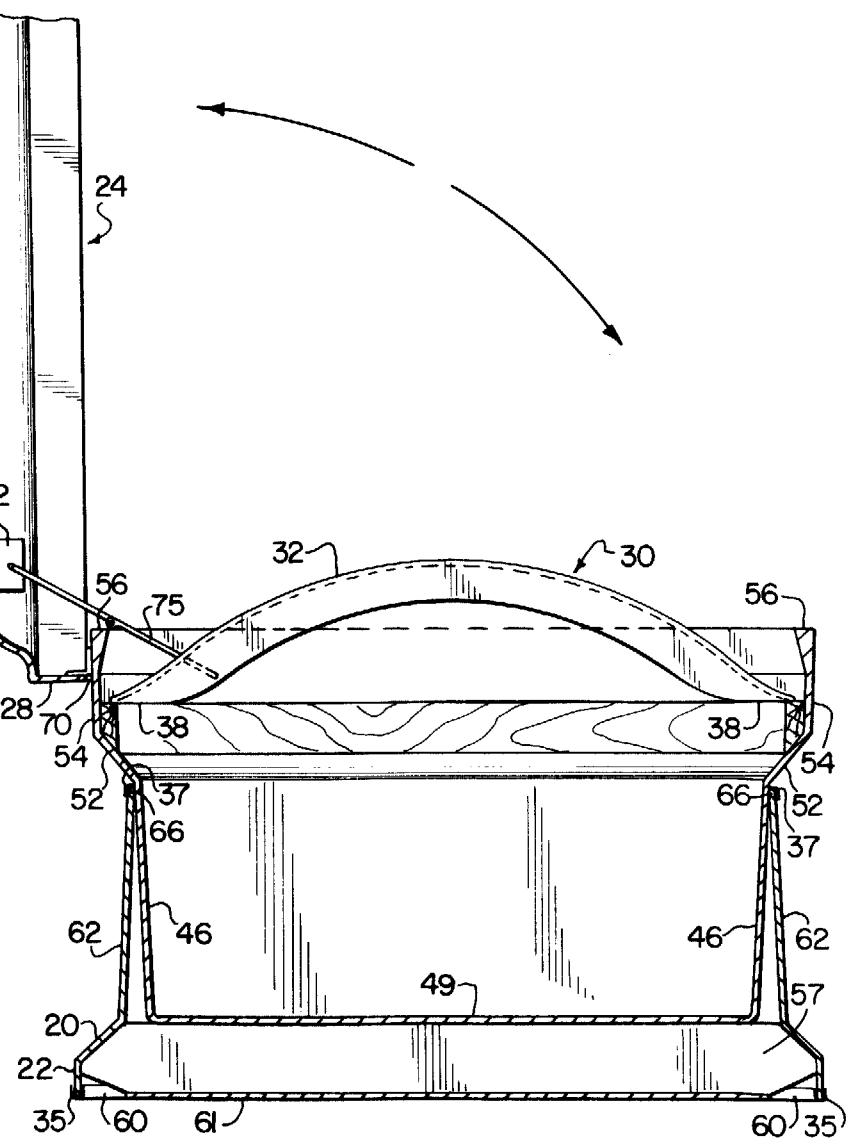
FIG. 4 is a cross sectional view similar to that of FIG. 3, illustrating the relationship of the casket lid to the casket body when the lid is in the open position.
Figure 12:
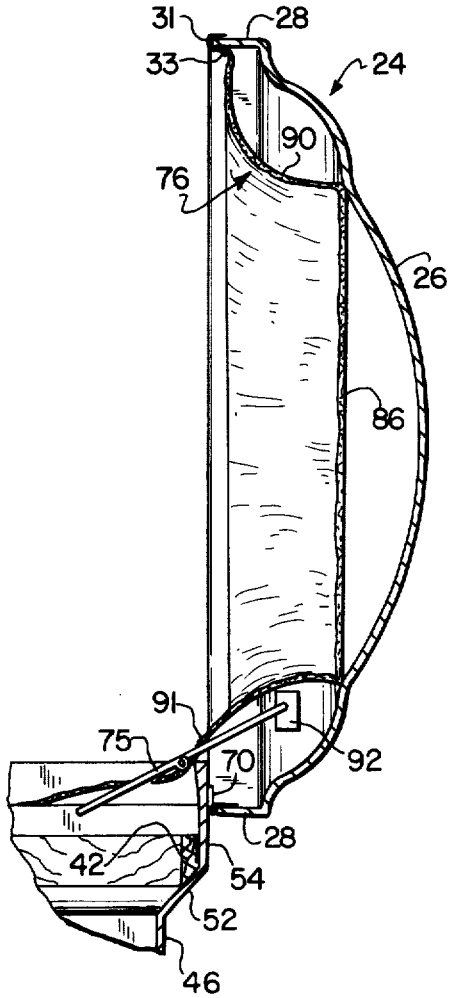
FIG. 12 illustrates the manner in which the removable lining and padding may be attached to the interior of the casket body, and also illustrates the knee brace mechanisms which may be employed on the casket lid.
Figure 16:
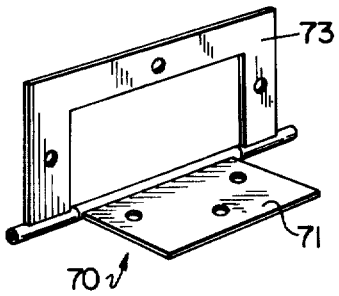
FIG. 16 is a perspective view of one of the hinges used to attach the casket lid to the casket body.

With reference now to FIG. 4, which illustrates a cross sectional view similar to that of FIG. 3, the casket lid 24 is maintained in the open position by two hinges 70 (only one of which is shown) placed along the outer surface of the upstanding lip portion 54 of the casket body 44. One of the hinges 70 is illustrated in perspective in FIG. 16. The hinges 70 are also connected to the inner surface of the depending lip portion 28 of the casket lid 24. The placement of the hinges 70 along the casket body 44 and casket lid 24 in conjunction with knee brace mechanisms 75 (as shown in FIG. 12) allows the casket lid 24 to be locked in the open position or sealed in the closed position, in the latter case without affecting the seal between the lid 24 to the casket body 44. Due to the ability of the two parts 71 and 73 of the hinge 70 to nest or interlock when the hinge is in the closed position, as will be apparent by reference to FIG. 16, the hinge 70 creates only a minimum intrusion in the area between the upstanding lip portion 54 of the casket body 44 and the depending lip portion 28 of the casket lid 24.

Figure 7:
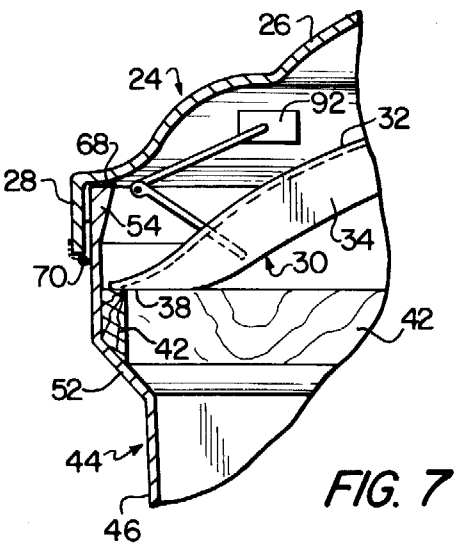
FIG. 7 is an enlarged partial cross sectional side view illustrating an exemplary hinge and knee brace mechanism which may be employed on the casket lid.
Figure 6:
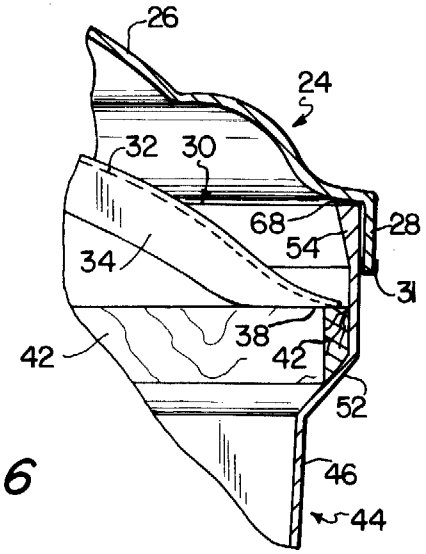
FIG. 6 is an enlarged partial cross sectional view illustrating the sealing arrangement between the lid and casket body.
Figure 15:
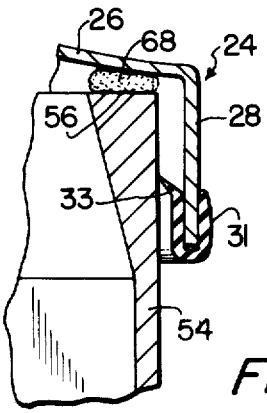
FIG. 15 is an enlarged side view of the casket illustrating the relationship of the U-shaped gasket to the casket body and lid when the latter are sealed together.

With particular reference now to FIGS. 6 and 7, which are enlarged cross-sectional views illustrating the sealing arrangement between the lid 24 and casket body 44, the depending lip 28 of the casket lid 24 extends over the periphery of the upstanding lip 54 when the lid is in the closed position relative to the casket body 44. The inward taper angle of the depending lip portion 28 of the casket lid 24 matches the outward taper angle of the upstanding lip portion 54 of the casket body 44, which allows gripping engagement between the lid and casket body. The flexible nature of the fiberglass material of which the lid 24 and casket body 44 are made allows the depending lip 28 of the lid to stretch or flex slightly as it is engaged with the outwardly-tapered lip 54 of the casket body 44, thereby creating an efficient hermetic seal between these two parts when the lid 24 is in the fully closed position. In the preferred embodiment, the nature of the seal is modified slightly by the U-shaped peripheral gasket or molding 31 which surrounds the free edge surface of the depending lip 28 of the casket lid 24. An enlarged cross-sectional view of the area of contact between the casket lid and casket body, with the U-shaped gasket applied to the edge of the depending lip portion 28 of the lid, is shown in FIG. 15. The gasket 31 includes a tongue portion 33 which runs along the interior periphery of the casket lid 24 to aid in the positioning of the lining and padding (not shown) which is normally provided in the interior of the casket lid (See FIGS. 11-12). When the lid 24 is to be closed, the lining will normally be pulled away from the lip portion 28 of the lid so that it does not interfere with the sealing of the lid to the casket body 44. Therefore, when the lid 24 is in the fully closed position as shown in FIG. 15, the tongue portion 33 of the gasket 31 will be maintained in direct contact with the outside surface of the upstanding lip portion 54 of the casket body. The gripping relationship which exists between the depending lip portion 28 of the lid and the upstanding lip portion 54 of the casket body, due to their complementary taper angles, insures that the tongue portion 33 of the gasket 31 is pressed firmly against the side of the upstanding lip portion 54 of the casket body. Thus, the gasket 31 and the tongue member 33 in conjunction with the sealing arrangement between the depending lip 28 of the casket lid 24 and the upstanding lip 54 of the casket body 44 has the effect of creating a hermetic seal between the casket lid 24 and the casket body 44 without the use of a sealant material. Preferably, however, the free edge surface 56 of the casket body 44 is suitably enlarged, as shown in FIGS. 6, 7 and 15, for receiving a suitable sealant material 68. When the lid is in the closed position, the sealant material 68 is compressed between the free edge surface 56 of the casket body 44 and the convex top portion 26 of the casket lid 30. Although the sealant material 68 is not necessary, it will be desirable in order to create an enhanced seal between the casket lid 24 and the casket body 44.

It should be pointed out that the gasket or molding 31 may be omitted, if desired, without adversely affecting the seal created between the lid 24 and casket body 44 of the combined assembly. In that case, the depending lip portion 28 of the lid overlaps and grippingly engages the upstanding lip portion 54 of the casket body directly, thereby creating an efficient hermetic seal between the two. However, it is preferable that the gasket 31 be retained since it provides a decorative molding for the edges of the casket lid and also assists in positioning and retaining the lining and padding which is normally provided on the interior of the casket lid 24, as will be explained in more detail hereinafter in connection with FIGS. 11 and 12. Gaskets 35 and 37, which are similar to the gasket 31 (except that the tongue portion 33 is omitted), may also be provided along the bottom and top edges of the display carrier 12, as shown in FIGS. 3-5, to provide a finished appearance.

Figure 8:
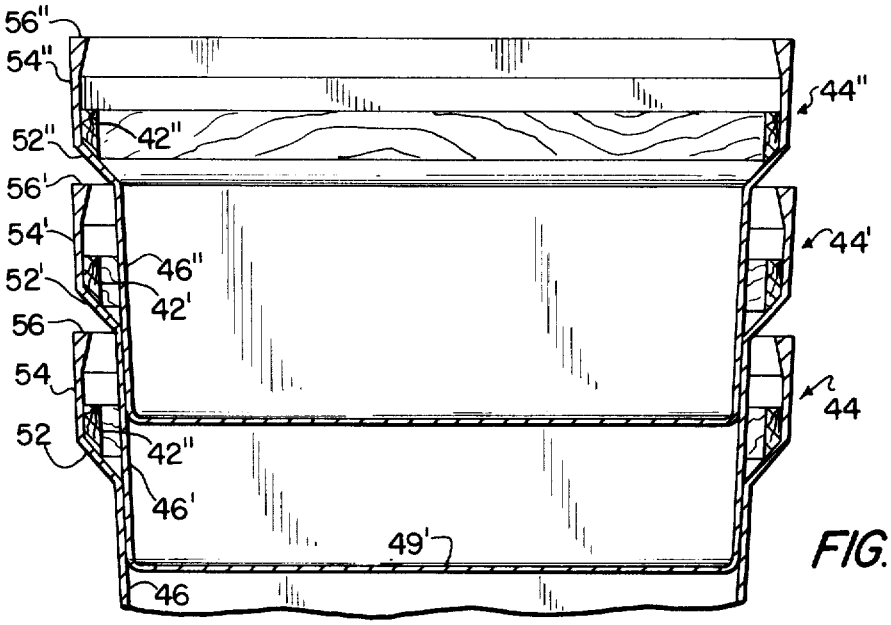
FIG. 8 is a cross sectional view illustrating the manner in which several casket bodies can be stacked or nested within one another.
Figure 9:
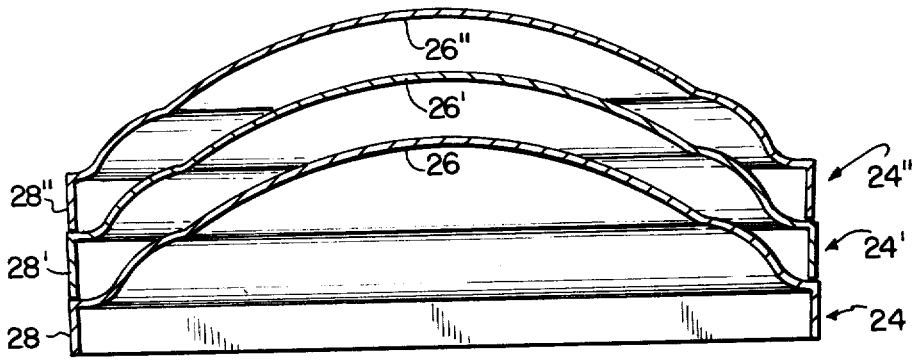
FIG. 9 is a cross sectional view illustrating the manner in which several casket lids may be stacked or nested within one another.
Figure 10:
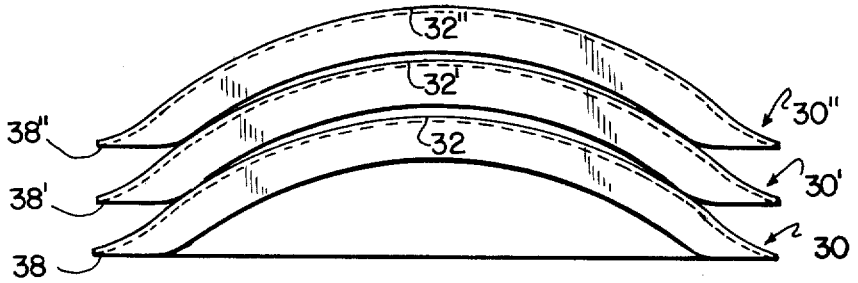
FIG. 10 is a cross sectional view illustrating the manner in which several half couches may be stacked or nested one within another.

FIGS. 8-10 illustrate the stacking of one like component part within another like part. Referring specifically to FIG. 8, the casket bodies due to their tapered side wall 46 and tapered end wall 48 construction are stackable one within another in a nested manner, decreasing the amount of storage space required, as compared with caskets of non-nestable configuration. As illustrated, casket body 44' is inserted into casket body 44 until the free edge surface 56 of casket body 44 substantially contacts casket body 44' at the point where the tapered side walls 46' and tapered end walls 48' of casket body 44' join the outwardly flared portion 52'. In this position, the tapered side walls 46' and end walls 48' of the casket body 44' rest flush against the tapered side walls 46 and end walls 48 of the next lower casket body 44. Another casket body 44" may be stacked within the casket body 44' in a similar manner.

With reference now to FIG. 9, which illustrates the stackable nature of the casket lids, the free edge surface 72 of casket lid 24' rests on the outer surface of the convex top portion 26 of casket lid 24 at the point where the convex top portion 26' downturns to become the depending peripheral lip portion 28'. The casket lids all rest squarely upon one another with the end portions and the side portions of the depending lip 28" contacting the next lower casket lid 24' in a like manner.

With reference now to FIG. 10, the half couches are stackable on top of one another so that the downturned lip 34' of half couch 30' rests upon the convex top portion 32 of the next lower half couch 30. The underside of the convex top portion 32' of half couch 30' rests substantially flush on the exterior of the convex top portion 32 of half couch 30. Half couch 30" is stacked on the next lower half couch 30' in the same manner.

Figure 11:
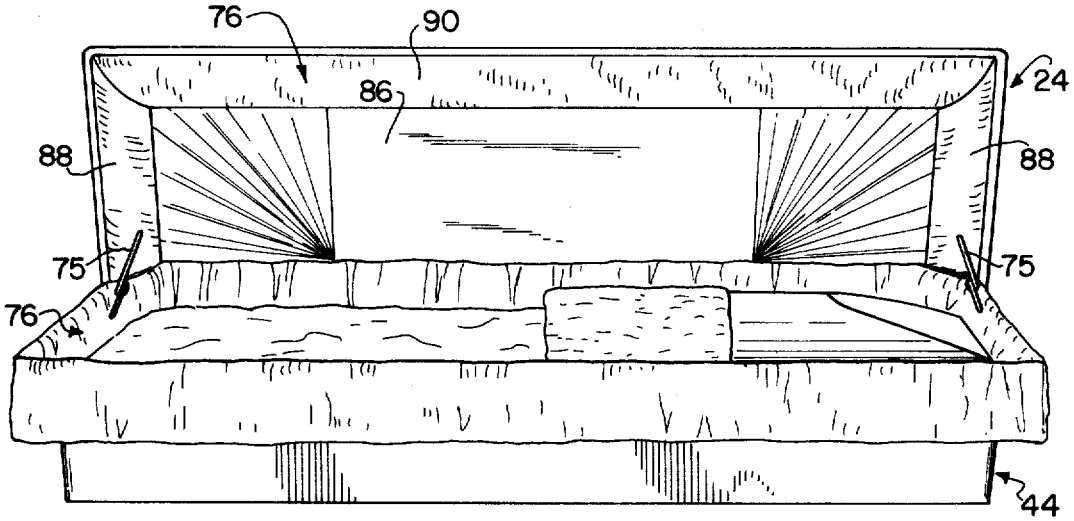
FIG. 11 is a perspective view of the combined casket and burial vault assembly with the lid open illustrating the removable interior lining and padding.

After the component parts are removed from storage and assembled, the combined casket and burial cault 10 will appear as illustrated in FIG. 11, which is a perspective view of a fully assembled combination casket and burial vault 10 with the lid 24 in the open position to illustrate the removable fabric lining and padding 76 which has been installed within the casket body 44 and casket lid 24. The installation of the lining and padding 76 within the casket lid 24 is illustrated in more detail in FIG. 12, which is a cross-sectional view of the lid 24 and a portion of the casket body 44 to which the lid is attached. The lining and padding 76 for the lid comprises a cap portion 86, two end inserts 88 (visible in FIG. 11) and a side insert 90, all of which comprise decorative fabric with a cardboard backing. The cap portion 86, end inserts 88 and side insert 90 are joined together by means of staple fasteners. A loose flap of fabric 91 is provided between the cap portion 86 and the lining and padding 76 in the casket body 44 to cover the hinged area between the lid 24 and the casket body. Suitable slots or holes are provided in the flap 91 to accomodate the knee brace mechanisms 75. The lining and padding 76 as a whole is fastened to the interior of the casket lid 24 by means of staple fasteners provided at the edges of the cap portion 86. The outer edges of the side inserts 90 and end inserts 88 are maintained in position by means of the overlying peripheral tongue portion 33 of the U-shaped gasket or molding 31. The tongue portion 33, which is more clearly visible in FIG. 15, preferably protrudes approximately one-eighth of an inch from the one side of the U-shaped gasket 31 and acts as a support member on which the side inserts 90 and end inserts 88 of the lining and padding 76 rest. The lining and padding 76 for the casket body 44 is conventional and therefore requires no detailed description herein.

With further reference to FIGS. 11 and 12, the knee brace mechanisms 75 are shown in the open and locked position, whereby for the casket body 44 is conventional and therefore requires the casket lid 24 is maintained in the open position as shown. The knee braces 75 are affixed to the casket body 44 at a point along the peripheral ledge surface 42 thereof. The knee braces 75 are likewise affixed to protruding wood members 92 provided on the interior of the casket lid 24 where the top portion 26 tapers downward toward the end portions of the depending peripheral lip portion 28.

Figure 13:
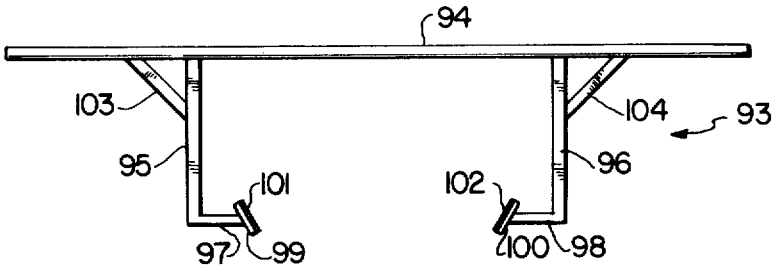
FIG. 13 is a front view of one of the interment bars used for removing the casket body from the casket carrier.
Figure 14:
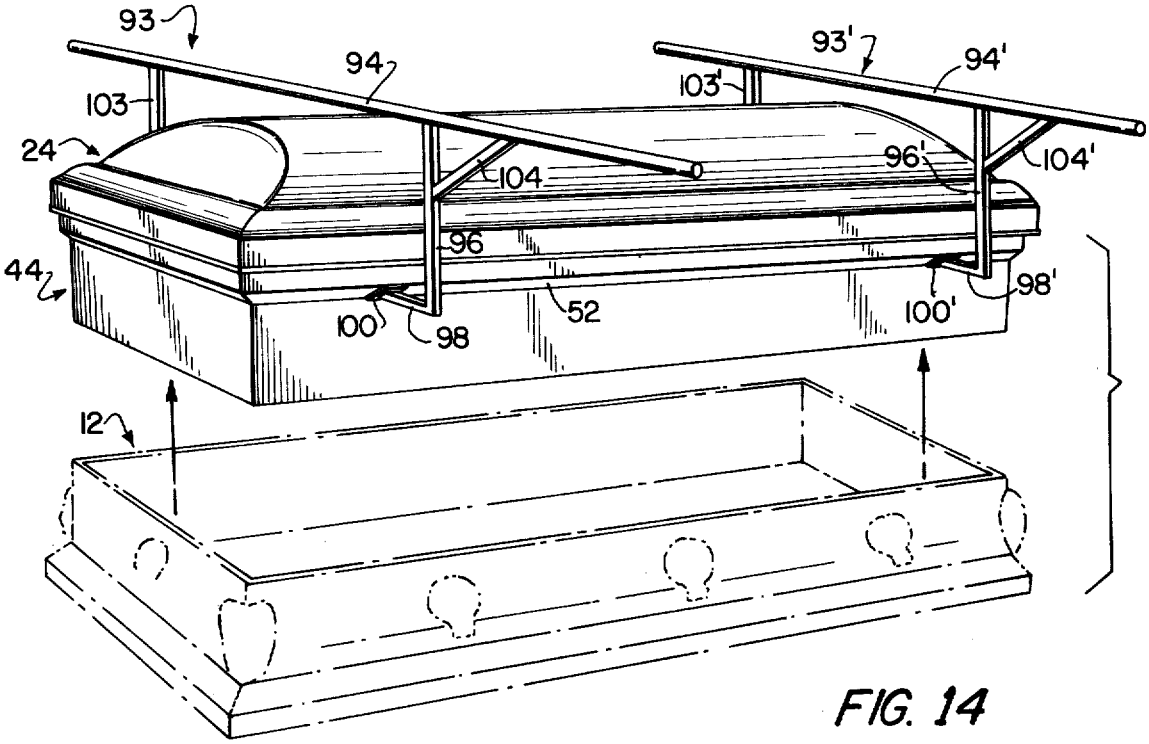
FIG. 14 is a perspective view illustrating the manner in which a pair of interment bars are used to vertically remove the casket body from the casket carrier.

FIG. 13 is a front elevational view of an interment bar 93 which is useful in removing the casket body 44 from the display carrier 12. The interment bar 93 comprises a straight horizontal carrying bar 94, two depending L-shaped bars 95, 96 attached thereon with their horizontal legs 97, 98 extending inwardly, and a pair of inclined support plates 99, 100 attached to the inner ends of the horizontal legs 97, 98 of the L-shaped bars 95, 96. Braces 103, 104 are provided for structural reinforcement between the horizontal carrying bar 94 and the depending L-shaped bars 95, 96. The inclination angle of the support plates 99, 100 corresponds to the angle of the outwardly flared portion 52 of the casket body 44. Protective pads 101, 102 of rubber or some other resilient material are provided on the surfaces of the support plates 99, 100 to prevent damage to the outer surface of the casket body 44. In use, a pair of interment bars 93, 93' are slidably engaged with the casket body 44 from either end thereof, as illustrated in FIG. 14. The support plates 99, 100 contact the outwardly flared portion 52 of both sides of the casket body 44 at points approximately eight inches from the end walls 48 of the casket body 44. The end portions of the carrying bars 94, 94' are capable of being lifted by cemetarians to remove the casket body 44 from the display carrier 12, as shown, and to enable the casket body to be moved to the burial plot.

In an exemplary embodiment of a combined casket and burial vault assembly 10 in accordance with the present invention, the display carrier 12 has two opposed side walls 46 which are about 74 inches in length and 12 inches in height and two opposed end walls 48 which are about 22 inches in length and 12 inches in height. The bottom roll or peripheral flared portion 18 of the casket carrier 12 tapers outwardly to a width of about 26½ inches and a length of about 78½ inches. The wall portion 22 of the flared portion 18 has a depth of about 2 inches. The casket body 44 has a top opening 58 which is about 81 inches in length and 26¼ inches in width, measured from the external peripheral edges of the upstanding lip portion 54 of the casket body 44. The upstanding lip portion 54 of the flange portion 50 has a depth of about 3¾ inches. Further, the bottom wall portion 49 of the casket body 44 has an internal length of about 77¾ inches and an internal width of about 22¼ inches. The peripheral ledge portion 42 of the casket body has a width of about ¾ inch. The casket body 44 has an overall depth of about 12¼ inches. The casket lid has a height of about 5½ inches measured from the peak of the convex top portion 26 to the free edge of the depending lip portion 28. The depending lip portion 28 extends a length of about 81½ inches, a width of about 26¾ inches and a depth of about 1⅞ inches. The half couch 30 has a length of about 40 inches and a width of about 25½ inches measured between the outer edges of the flat bottom surface 38. It is to be understood that the foregoing dimensions are given by way of example only and are not intended to limit the scope of the invention in any way.

Although the present invention has been described with reference to a preferred embodiment, it will be understood that the invention is not limited to the details thereof. A number of possible modifications and substitutions therein have been noted in the foregoing detailed description, and others will occur to those of ordinary skill in the art. All such modifications and substitutions are intended to fall within the spirit and scope of the invention as defined in the appended claims.

What is claimed is:

1. A combined casket and burial vault assembly of molded material comprising:

(a) a casket body having two opposed side walls, two opposed end walls and a bottom wall, said side walls and said end walls tapering outwardly from said bottom wall and terminating at their upper edges in a peripheral flange portion which defines an enlarged top opening for the casket body, said flange portion comprising:

(1) a flared portion extending outwardly from said side walls and said end walls at an angle relative to the vertical which is greater than the taper angle of said side walls and said end walls, respectively, (2) an upstanding lip portion tapering outwardly from said flared portion at an angle relative to the vertical which is less than the angle of said flared portion, said upstanding lip portion terminating in a free edge surface suitable for receiving a sealant material, (b) a lid receivable on the enlarged top opening of said casket body, said lid having a convex top porton and a depending peripheral lip portion, said depending lip portion tapering inwardly from said convex top portion at an angle corresponding to the outward taper angle of the upstanding lip portion of the casket, whereby said depending lip portion may be placed in overlapping and gripping relationship with the upstanding lip portion of said casket body when the lid is closed over the enlarged top opening of the casket body, with the free edge surface of said upstanding lip portion thereby being brought substantially into contact with the interior surface of the convex top portion of the lid for retaining a sealant material therebetween; and (c) a display carrier for receiving said casket body, said display carrier comprising two opposed side walls, two opposed end walls, and a bottom wall.

2. A combined casket and burial vault assembly as claimed in claim 1, wherein said casket body is further provided with a flat peripheral ledge surface extending along the interior of the peripheral flange portion thereof, and wherein the assembly further comprises a removable half couch receivable in the casket body below said casket lid, said half couch having a convex top portion and a flat bottom edge surface along at least two sides thereof for resting on the flat peripheral ledge surface of the casket body.

3. A combined casket and burial vault assembly as claimed in claim 2, wherein the side walls and end walls of said display carrier terminate in a free edge surface which is brought into abutting contact with the flange portion of the casket body when the casket body is received within the display carrier.

4. A combined casket and burial vault assembly is claimed in claim 3, wherein said abutting contact occurs along the line at which the flared portion of said peripheral flange joins the tapered side walls and tapered end walls of the casket body.

5. A combined casket and burial vault assembly as claimed in claim 4, wherein the bottom wall of said display carrier comprises:

(a) a plurality of lateral support beams extending between the side walls of said display carrier; and (b) a flat base enclosure supported by said lateral support beams, said base enclosure having dimensions less than the dimensions of the bottom of the display carrier in order to provide a circumferential opening therein.

6. A combined casket and burial vault assembly as claimed in claim 1, wherein the depending lip portion of the casket lid is provided with a U-shaped gasket enclosing the free edge thereof, said U-shaped gasket having a projecting tongue portion along one side thereof whcih is brought into sealing contact with the outside surface of the upstanding lip portion of the casket body when the casket lid is closed over the casket body.

7. A combined casket and burial vault assembly as claimed in claim 6, wherein a fabric lining is provided on the interior of said casket lid, and wherein the edges of said fabric lining are maintained in position by the projecting tongue portion of said Ushaped gasket.

8. A combined casket and burial vault assembly as claimed in claim 2, wherein said casket body, said casket lid, said half courch, and the side walls and end walls of said display carrier are made of a resinous glass fiber material.

9. A combined casket and burial vault assembly comprising:

(a) a casket body having two opposed side walls, two opposed end walls, and a bottom wall, said side walls and said end walls terminating at their upper edges in an outwardly-flared peripheral flange portion which defines an enlarged top opening for the casket body;

(b) a lid receivable over the enlarged top opening of said casket body;

(c) a display carrier for receiving said casket body, said display carrier comprising two opposed side walls, two opposed end walls, and a bottom wall; and (d) first and second interment bars engageable with said casket body to facilitate vertical removal of the casket body from said display carrier, each of said interment bars comprising:

(1) a horizontal carrying bar, (2) first and second depending L-shaped members attached to said horizontal carrying bar with the horizontal legs of said L-shaped members facing inward toward each other, (3) first and second inclined support plates attached to the ends of the inwardly-facing horizontal legs of said first and second L-shaped members, respectively, the angle of inclination of said support plates corresponding to the angle of inclination of the outwardly-flared peripheral flange portion of the casket body.

10. A combined casket and burial vault assembly as claimed in claim 9, wherein said support plates are provided with pads of resilient material to prevent marring of the outside surface of the casket body.

* * * * *